US007730943B2

(12) United States Patent
Farley

(10) Patent No.: US 7,730,943 B2
(45) Date of Patent: Jun. 8, 2010

(54) DETERMINATION OF AZIMUTHAL OFFSET AND RADIUS OF CURVATURE IN A DEVIATED BOREHOLE USING PERIODIC DRILL STRING TORQUE MEASUREMENTS

(75) Inventor: Steven Reid Farley, Magnolia, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 0 days.

(21) Appl. No.: 12/110,460

(22) Filed: Apr. 28, 2008

(65) Prior Publication Data

US 2009/0266610 A1 Oct. 29, 2009

(51) Int. Cl.
*E21B 47/024* (2006.01)

(52) U.S. Cl. ..... 166/250.01; 166/255.2; 175/45

(58) Field of Classification Search ..... 166/250.01, 166/255.2; 175/45
See application file for complete search history.

(56) References Cited

U.S. PATENT DOCUMENTS

| | | | | |
|---|---|---|---|---|
| 2,933,820 | A | 4/1960 | Bobo | |
| 3,359,782 | A | 12/1967 | Van Bey | |
| 6,131,953 | A * | 10/2000 | Connell et al. | 285/3 |
| 6,913,095 | B2 * | 7/2005 | Krueger | 175/76 |
| 7,287,604 | B2 * | 10/2007 | Aronstam et al. | 175/61 |
| 7,556,105 | B2 * | 7/2009 | Krueger | 175/45 |
| 2005/0056463 | A1 * | 3/2005 | Aronstam et al. | 175/61 |
| 2006/0021797 | A1 * | 2/2006 | Krueger | 175/61 |
| 2009/0057018 | A1 * | 3/2009 | Farley | 175/73 |

FOREIGN PATENT DOCUMENTS

| | | | |
|---|---|---|---|
| WO | 0134935 | A1 | 5/2001 |
| WO | 2009032367 | A2 | 3/2009 |

OTHER PUBLICATIONS

International Combined Search and Examination Report received in UK application No. GB0901735.1 dated Jun. 29, 2009.
Examination Report received in UK application GB0901735.1 dated Dec. 2, 2009.

* cited by examiner

*Primary Examiner*—Shane Bomar
(74) *Attorney, Agent, or Firm*—Wong, Cabello, Lutsch, Rutherford & Brucculeri L.L.P.

(57) ABSTRACT

Methods and apparatus for determining the direction of borehole azimuthal offset and the borehole radius of curvature. Rotation rate of a borehole assembly is measured and mathematically converted into azimuthal torque imparted to the borehole assembly. Relative azimuthal offset is determined from variations in azimuthal torque over a rotation cycle of the borehole assembly. Relative radius of curvature is obtained from the magnitude of azimuthal torque over a rotation cycle. Relative azimuthal offset is converted to true azimuthal offset using an independent reference angle measurement. Relative borehole curvature is converted to true radius of curvature using a calibration constant determined in known borehole conditions.

13 Claims, 4 Drawing Sheets

DETERMINATION OF AZIMUTHAL OFFSET AND RADIUS OF CURVATURE IN A DEVIATED BOREHOLE USING PERIODIC DRILL STRING TORQUE MEASUREMENTS

FIELD OF THE INVENTION

This invention is related to the directional drilling of a well borehole. More particularly, the invention is related to the determination of azimuthal survey offset and radius of curvature of the borehole using measures of drill string torque.

BACKGROUND

The complex trajectories and multi-target oil wells require precision placement of well borehole path and the flexibility to continually maintain path control. It is preferred to control or "steer" the direction or path of the borehole during the drilling operation. It is further preferred to determine and to control the path rapidly during the drilling operation at any depth and target as the borehole is advanced by the drilling operation.

Directional drilling is complicated by the necessity to operate a drill bit steering device within harsh borehole conditions. The steering device is typically disposed near the drill bit, which terminates a lower or "down hole" end of a drill string. In order to obtain the desired real time directional control, it is preferred to operate the steering device remotely from the surface of the earth based upon real time measures of borehole azimuthal offset and curvature. Furthermore, the steering device must be operated to maintain the desired path and direction while being deployed at possibly a great depth within the borehole and while maintaining practical drilling speeds. Finally, the steering device must reliably operate under exceptional heat, pressure, and vibration conditions that can be encountered during the drilling operation.

Many types of directional steering devices, comprising a motor disposed in a housing with an axis displaced from the axis of the drill string, are known in the prior art. The motor can be a variety of types including electric, or hydraulic. Hydraulic turbine motors operated by circulating drilling fluid are commonly known as "mud" motors. A rotary bit is attached to a shaft of the motor, and is rotated by the action of the motor. The axially offset motor housing, commonly referred to as a bent subsection or "bent sub", provides axial displacement that can be used to change the trajectory of the borehole. By rotating the drill bit with the motor and simultaneously rotating the drill bit with the drill string, the trajectory or path of the advancing borehole is parallel to the axis of the drill string. By rotating the drill bit with the motor only, the trajectory of the borehole is deviated from the axis of the drill string. By alternating these two methodologies of drill bit rotation, the path of the borehole can be controlled. A more detailed description of directional drilling using the bent sub concept is presented in U.S. Pat. Nos. 3,713,500, 3,841,420 and 4,492,276, which are herein entered into this disclosure by reference.

The prior art contains methods and apparatus for adjusting the angle of "bend" of a bent sub housing thereby directing the angle of borehole deviation as a function of this angle. The prior art also contains apparatus and methods for dealing with unwanted torques that result from steering operations including clutches that control relative bit rotation in order to position the bit azimuthally as needed within the walls of the borehole. Prior art steering systems using variations of the bent sub concept typically rely upon complex pushing or pointing forces and the associated equipment which directs the hole path by exerting large pressures on the bit perpendicular to the borehole path while rotating the drill string. These forces are often obtained using hydraulic systems that are typically expensive and present additional operational risks in the previously mentioned harsh drilling environment. Furthermore, these perpendicular forces typically require the steering device to be fabricated with mechanically strong components thereby further increasing the initial and operating cost of the steering device.

U.S. patent application Ser. No. 11/848,328, which is entered into this disclosure by reference, discloses apparatus and methods for steering the direction of a borehole advanced by cutting action of a rotary drill bit terminating a lower or "down hole" end of a drill string. The rotation speed of the bit is periodically varied during a rotation of the drill string thereby cutting a disproportionately larger amount of material from an azimuthal arc of wall of the borehole, which will results in an azimuthal deviation in borehole direction. The steering device, which is disposed at the downhole end of a drill string, comprises a motor disposed in a bent housing subsection or "bent sub". A rotary drill bit is attached to a shaft of the motor. The drill bit can be rotated by both the motor and by the rotary action of the drill string. To deviate the borehole, rotation rate of the bit is periodically slowed or "pulsed" in a predetermined arc thereby cutting a disproportionally small amount of material from the borehole wall. As a result, the bit moves to the opposite side of the borehole and cuts disproportionately larger amount of material from the borehole wall. The borehole then tends to deviate and advance in the azimuthal direction in which the disproportional large amount of borehole wall material has been removed. This methodology is referred to as a Pulsed Modulated Steering.

Regardless of the steering system employed, the effective direction of a borehole to a predetermined target requires reliable, accurate, precise, and preferably real time measures of the azimuthal offset and curvature of the borehole at or very near the drill bit.

SUMMARY OF THE INVENTION

This invention comprises apparatus and methods for determining azimuthal offset and radius of curvature of a well borehole. Direction of azimuthal offset and radius of curvature are referred to in this disclosure as borehole orientation "parameters of interest", and are determined from the effects of azimuthal torque imparted to a borehole assembly (BHA) that terminates the lower end of the drill string. In a non-deviated borehole, azimuthal torque is relatively constant throughout a 360-degree rotation "cycle" of the BHA. In a deviated borehole, azimuthal torque exhibits a typically periodic component. The direction of azimuthal offset and the borehole radius of curvature are obtained from effects of periodic azimuthal torque at the BHA.

Borehole orientation parameters are typically obtained from instrumentation that is typically axially offset uphole from the drill bit by 100 feet (30.5 meters) or more. This axial offset can introduce significant error in determining in real time the path of the advancing borehole. Torque and/or changes in torque can be determined practically at the BHA within a 3 or 4 foot axial offset (0.91 to 1.22 meters) uphole from the drill bit. Periodic azimuthal torque or periodic changes in azimuthal torque, measured at this reduced axial offset, are processed to yield azimuthal offset and radius of curvature of the borehole within 3 to 4 feet of the drill bit. Determination of these borehole parameters of interest very close to the drill bit and in real time is advantageous in directing the path of the borehole using any type of borehole steering methodology.

BRIEF DESCRIPTION OF THE DRAWINGS

The manner in which the above recited features and advantages, briefly summarized above, are obtained can be understood in detail by reference to the embodiments illustrated in the appended drawings.

DETAILED DESCRIPTION OF THE PREFERRED EMBODIMENTS

This invention comprises apparatus and methods for determining direction of azimuthal offset and the radius of curvature of a well borehole. The invention can be embodied with a variety borehole steering systems. For purposes of disclosure, the invention will be embodied with a pulsed modulated steering system that is disclosed in U.S. patent application Ser. No. 11/848,328 and previously entered into this disclosure by reference.

Hardware

Figure 1:
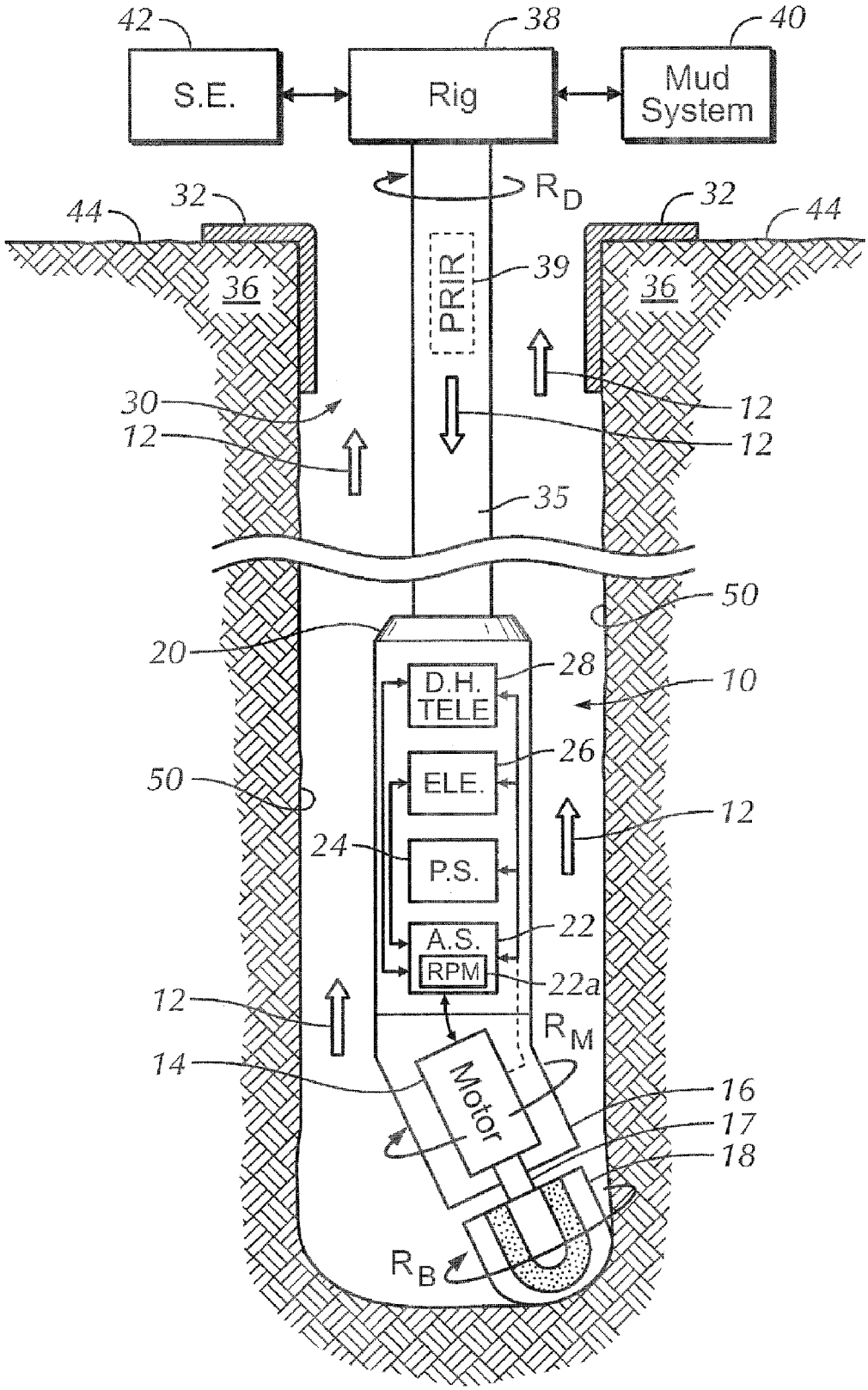
FIG. 1 illustrates a measurement-while-drilling/-logging-while-drilling system comprising a borehole assembly disposed in a straight segment of well borehole.

Attention is directed to FIG. 1, which illustrates a borehole assembly (BHA) 10 suspended in a borehole 30 defined by a wall 50 and penetrating earth formation 36. The upper end of the BHA 10 is operationally connected to a lower end of a drill pipe 35 by means of a suitable connector 20. The upper end of the drill pipe 35 is operationally connected to a rotary drilling rig, which is well known in the art and represented conceptually at 38. Surface casing 32 extends from the borehole 30 to the surface 44 of the earth. Elements of the steering apparatus are disposed within the BHA 10. Motor 14 is disposed within a bent sub 16. The motor 14 can be electrical or a Monyo or turbine type motor. A rotary drill bit 18 is operationally connected to the motor 14 by a motor shaft 17, and is rotated as illustrated conceptually by the arrow $R_B$.

Again referring to FIG. 1, the BHA 10 also comprises an auxiliary sensor section 22, a power supply section 24, an electronics section 26, and a downhole telemetry section 28. The auxiliary sensor section 22 comprises directional sensors such as magnetometers and inclinometers that can be used to indicate orientation of the BHA 10 within the borehole 30 relative to an absolute reference such as magnetic north or true gravity. This information, in turn, is used in defining the borehole trajectory path for the steering methodology, and more particularly to determine an absolute direction of azimuthal borehole deviation. The auxiliary sensor section 22 comprises a sensor 22*a* for measuring the rotation rate of the BHA 10. In the preferred embodiment, azimuthal torque at the BHA 10 is obtained by monitoring its effect on measured rotation rate of the BHA. Borehole directional parameters are then obtained from variations in azimuthal torque, as will be discussed in detail in subsequent sections of this disclosure. The auxiliary sensor section 22 can also comprise other sensors used in Measurement-While-Drilling (MWD) and Logging-While-Drilling (LWD) operations including, but not limited to, sensors responsive to gamma radiation, neutron radiation and electromagnetic fields.

Still referring to FIG. 1, the electronics section 26 comprises electronic circuitry to operate and control other elements within the BHA 10. The electronics section 26 preferably comprise downhole memory (not shown) for storing directional drilling parameters, measurements made by the sensor section, and directional drilling operating systems. The electronic section 26 also preferably comprises a downhole processor to process various measurement and telemetry data. As an example, the downhole processor is preferably used to determine maximum and minimum in periodic azimuthal torques at the BHA 10 from measures of BHA rotation rates. Borehole parameters of interest are subsequently determined in the downhole processor from angular positions of maximum and minimum of periodic torques. Elements within the BHA 10 are in communication with the surface 44 of the earth via a downhole telemetry section 28. The downhole telemetry section 28 receives and transmits data to an uphole telemetry section (not shown) preferably disposed within surface equipment 42. Various types of borehole telemetry systems are applicable including mud pulse systems, mud siren systems, electromagnetic systems and acoustic systems. A power supply section 24 supplies electrical power necessary to operate the other elements within the BHA 10. The power is typically supplied by batteries.

Once again referring to FIG. 1, drilling fluid or drilling "mud" is circulated from the surface 44 downward through the drill string comprising the drill pipe and BHA 10, exits through the drill bit 18, and returns to the surface via the borehole-drill string annulus. Circulation is illustrated conceptually by the arrows 12. The drilling fluid system is well known in the art and is represented conceptually at 40. If the motor 14 is a turbine or "mud" motor, the downward flow of drilling fluid imparts rotation to the drill bit 18 through the shaft 17, as indicated by the arrow $R_M$. For purposes of illustration in FIG. 1, it is assumed that the motor 14 is a mud motor. As mentioned previously, the present invention is disclosed as being embodied with a pulse modulated borehole steering system that is disclosed in previously referenced U.S. patent application Ser. No. 11/848,328.

Still referring to FIG. 1, the rotary rig 38 imparts an additional rotation component, indicated conceptually by the arrow $R_D$, to the rotary drill bit 18 by rotating the drill pipe 35. Drill string rotation speed is typically controlled from the surface, using the surface equipment 42, based upon predetermined trajectory information or from BHA orientation information telemetered from sensors in the auxiliary sensor section 22. Motor rotation speed (indicated conceptually by the arrow $R_M$) is typically controlled by signals telemetered from the surface using BHA 10 position and orientation information measured by the auxiliary section 22 and telemetered to the surface. Alternately, motor rotational speed $R_M$ can be controlled using orientation information measured by the auxiliary sensor section cooperating with predetermined control information stored in a downhole processor within the electronics section 26.

Again referring to FIG. 1, the parameter $R_D$ is typically measured at the surface of the earth. In deviated boreholes, the rotation of the BHA 10 typically differs from $R_D$ in that the BHA experiences periodic variations in or variances of azimuthal torque, as will subsequently be illustrated. The rotation rate of the BHA 10, over a predetermined arc of rotation within a rotation cycle, is denoted conceptually by the arrow $_{RD,BHA}$. The variations or "surges" in azimuthal torque, preferably obtained from measures of $_{RD,BHA}$, are used to determine the previously defined borehole parameters of interest. Periodic variations in $R_{D,BHA}$ (and thus variations in azimuthal torque) are typically damped and broadened such that they can not be accurately and precisely measured at the surface of the earth.

Basic Concepts

The BHA 10, as shown in FIG. 1, is disposed in a non-deviating or straight borehole. When rotated at a constant rotation speed within the borehole 30, the BHA 10 sweeps a circular path drilling a borehole slightly larger than the diameter of the drill bit 18. This larger diameter, defined by the borehole wall 50, is due to the angle defined by the axis of the drill pipe 35 and the axis of the bent sub housing 16.

As discussed previously, two source components of drill bit rotation are present. The first component results from the action of the drilling rig 38 that rotates the entire drill string at a rotation rate of $R_D$. The second component of rotation results from the action of the motor 14 that rotates the bit at a rate RM. Ignoring variations in the BHA 10 resulting from periodic torque, the rotation speed of the drill bit, $R_B$, is $$R_B=R_D+R_M \tag{1}$$

If a constant or "straight" trajectory hole is require to be drilled, then the drill string rotation $R_D$ is initiated along with motor rotation $R_M$, the azimuthal angle of the bent sub 16 is no longer constant due to the rotation of the BHA 10, and the drill bit rotating at $R_B=R_M+R_D$ cuts equally into all sides of hole. In a straight borehole environment as illustrated in FIG. 1, the BHA 10 experiences no periodic variations in azimuthal torque. In this environment, $R_D=R_{D,BHA}$. This is illustrated conceptually in FIG. 2*a* which is a plot of $R_D=R_{D,BHA}$ (ordinate) versus azimuthal arc position θ in degrees (abscissa) of the BHA for three complete rotation cycles. The curve 51 illustrates a relatively constant value of $R_D=R_{D,BHA}$. As mentioned previously, $R_{D,BHA}$ is preferably the measured quantity and is obtained from sensor 22*a* as will be discussed subsequently in more detail. Azimuthal torque is computed from measured rotation rate using a general relationship $$T(\theta)=A_T+B_T(dR_{D,BHA}/d\theta) \tag{2}$$

where

T(θ)=azimuthal torque at a predetermined arc θ in a rotation cycle;

θ=a predetermined arc in a rotation cycle; and $A_T$ and $B_T$=offset and multiplicative calibration constants, respectively.

Figure 2A:
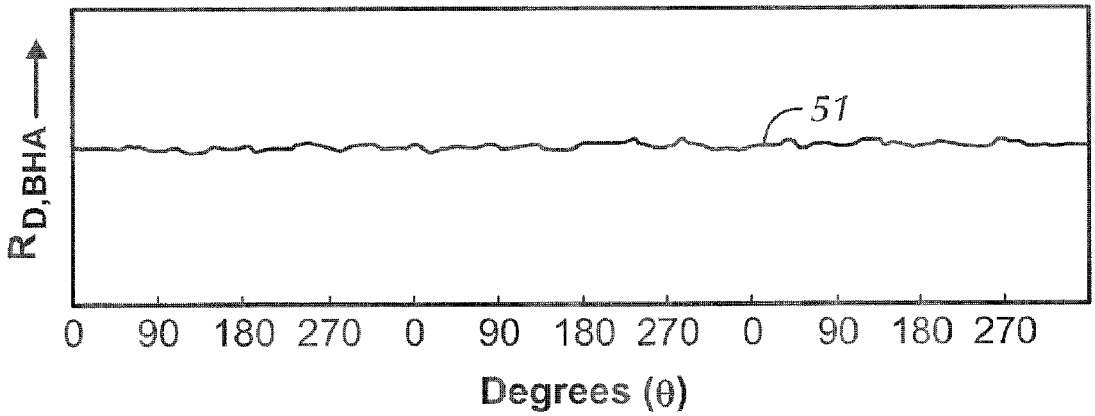
FIG. 2*a* illustrates rate of rotation of the borehole assembly over three rotation cycles in a straight segment of borehole.
Figure 2B:
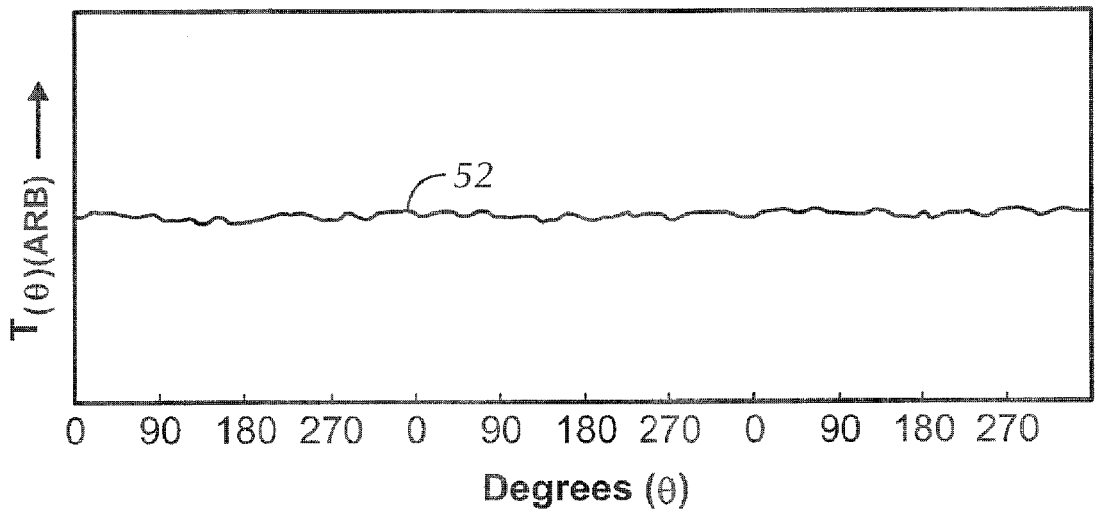
FIG. 2*b* illustrates azimuthal torque on the borehole assembly in a straight segment of borehole.

The predetermined arc defining each value of θ is preferably about 2 degrees. FIG. 2*b* illustrates conceptually the determination of azimuthal torque T(θ) in arbitrary units at the BHA 10 using equation (2) and the measured parameter $R_{D,BHA}$. More specifically, FIG. 2*b* is a plot of T(θ) (ordinate) versus azimuthal arc position θ in degrees (abscissa) of the BHA in a straight borehole for three complete rotation cycles. The curve 52, like the curve 50 in FIG. 2*a*, illustrates a relatively constant value of T(θ).

The two components $R_{D,BHA}$ or $R_D$ and $R_M$ comprising the final drill bit rotation speed $R_B$ are generally considered separable where directional control is required. If $R_D$ is decreased and the motor 14 continues to turn the drill bit 18 at a rotation speed $R_M$, the drill bit will increase borehole azimuthal offset at a constant azimuthal angle defined by the position of the slowly rotating bent sub 16, with the drill string sliding down the borehole behind the advancing drill bit.

In the periodic procession of the drill bit around the wall of the borehole described above, where $R_D$ and $R_M$ are not equal to zero, the drill bit 18 cuts a different azimuthal section of the hole as a function of procession time. Using the pulsed modulated steering system previously referenced, $R_B$ can be instantaneously and periodically changed during each revolution of the BHA 10 to preferentially cut one side of the hole at a different rate than it cuts the opposite side of the hole. Borehole deviation also introduces periodic variations in torque at the BHA thus allowing borehole parameters of interest to be determined in real time. This methodology is disclosed using the following conceptual illustrations.

Figure 3A:
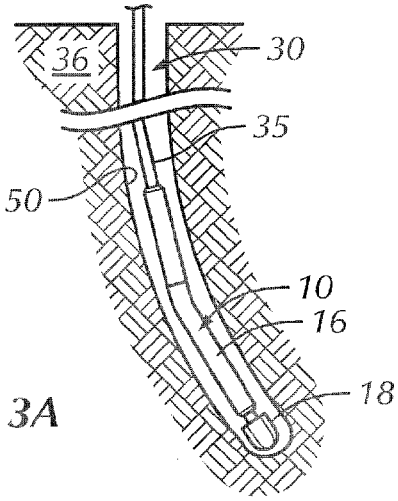
FIG. 3*a* illustrates the borehole assembly disposed in a segment of deviated borehole at an angle $\theta_1$, where $\theta_2$ is measured with respect to a reference or "zero" angle.
Figure 3B:
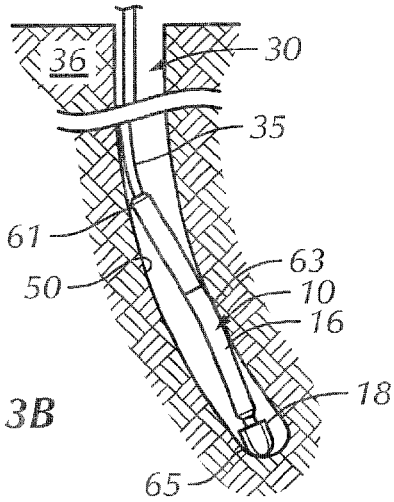
FIG. 3*b* illustrates the borehole assembly disposed in the same segment of deviated borehole at an angle $\theta_2$, where $\theta_2=\theta_1=180°$.

FIG. 3*a* illustrates the BHA 10 disposed in a deviated borehole segment 30 at an angle $\theta_1$, where $\theta_1$ is measured with respect to a reference or "zero" angle defined by directional instrumentation in the auxiliary section 22 (see FIG. 1 and previously referenced U.S. patent application Ser. No. 11/848,328)). It can be seen that azimuthal torque in this geometry is minimal and results only from the action of the drill bit 18 cutting formation 36 and possible binding uphole of the drill string 35. FIG. 3*b* illustrates the BHA 10 disposed in the same deviated segment of the borehole 30 (with the same radius of curvature) at an angle $\theta_2=\theta_1+180$ degrees. FIG. 3*b* illustrates conceptually maximum axial torque at the BHA 10. Azimuthal torque is at a maximum because of the maximized binding occurring between the BHA 10 and the borehole wall 65, 63 and 61.

Figure 4A:
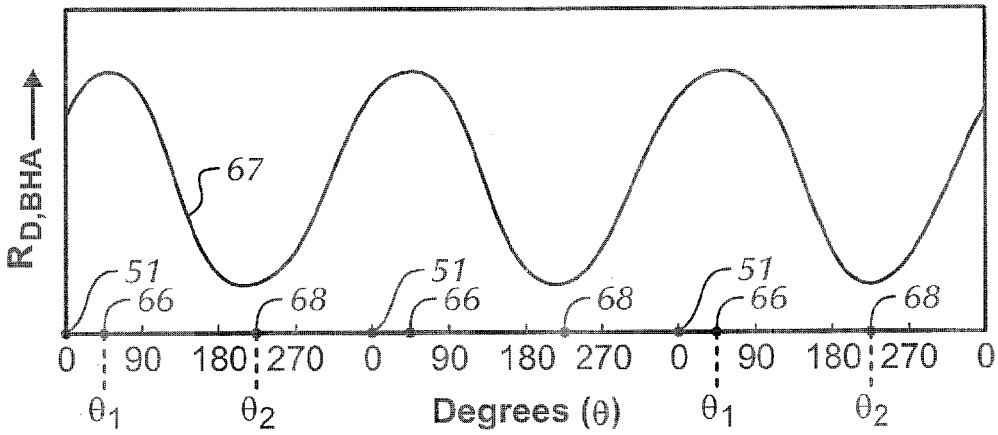
FIG. 4*a* is a graphical illustration of borehole assembly rotation rate versus azimuthal arc position $\theta$ in degrees for three complete rotation cycles rotating through the orientations at $\theta_1$ and $\theta_2$.

FIG. 4*a* is a graphical illustration of $R_{D,BHA}$ (ordinate) versus azimuthal arc position θ in degrees (abscissa) of the BHA for three complete rotation cycles rotating through the orientations at $\theta_1$ and $\theta_2$ as shown in FIGS. 3*a* and 3*b*, respectively. The curve 67 illustrates a periodically oscillating component of $R_{D,BHA}$, with maxima and minima occurring at 66 (angle $\theta_1$) and 68 (angle $\theta_2$), respectively.

Figure 4B:
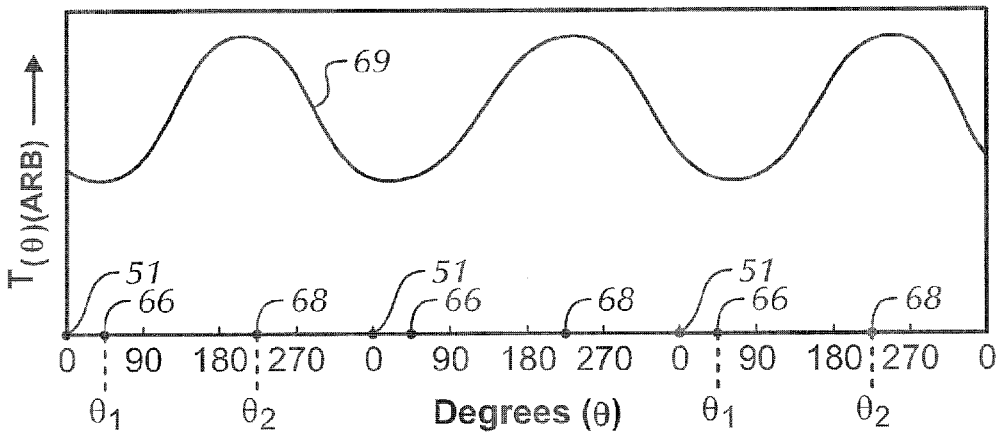
FIG. 4*b* is a graphical illustration of corresponding azimuthal torque versus azimuthal are position $\theta$ in degrees for three complete rotation cycles rotating through the orientations at $\theta_1$ and $\theta_2$.

FIG. 4*b* illustrates the corresponding values of azimuthal torque T(θ) (in arbitrary units) computed using equation (2) along with the measured values of $R_{D,BHA}$ shown in FIG. 4*a*. The azimuthal torque likewise shows a periodically oscillating function with minimum and maximum values of T(θ) occurring at 66 (angle $\theta_1$) and 68 (angle $\theta_2$), respectively.

It is apparent from the conceptual illustrations in FIGS. 3*a* and 3*b*, and the graphical illustration in FIG. 4*b*, that relative direction of azimuthal offset of the BHA 10 can be obtained by detecting minima and maxima in T(θ) for each rotation cycle. Absolute direction of azimuthal offset can optionally be determined by combining the relative azimuthal offset with a measure of the reference angle 51. This reference angle measurement is preferably obtained from an absolute gravity or alternately a magnetic north measurement in the auxiliary instrument section 22 of the BHA 10 (see FIG. 1).

Figure 5A:
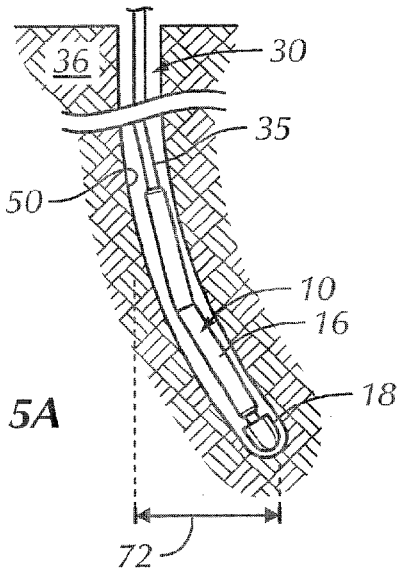
FIG. 5*a* illustrates the borehole assembly oriented at angle $\theta_1$ in a borehole with a first radius of curvature.
Figure 5B:
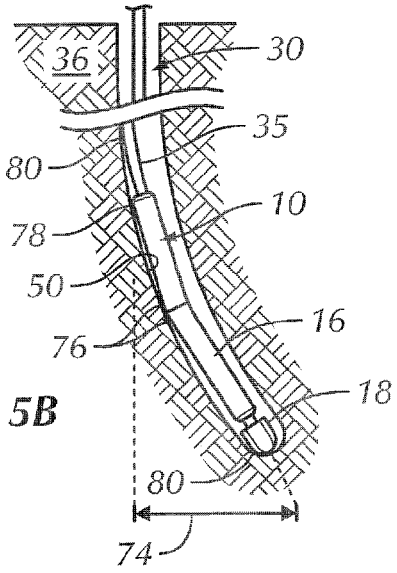
FIG. 5*b* illustrates the borehole assembly again oriented at angle $\theta_1$ but in a borehole that has a second radius of curvature which is larger that the first radius of curvature.

As mentioned previously, FIGS. 3*a* and 3*b* illustrate the BHA 10 disposed within a segment of borehole 30 of the same radius of curvature. FIG. 5*a* illustrates the BHA 10 oriented at angle $\theta_1$, where the borehole 30 has a radius of curvature proportional to the offset 72. FIG. 5*b* illustrates the BHA 10 again oriented at angle $\theta_1$ but in a borehole 30 that has a radius of curvature proportional to the larger offset 74. Stated another way, the radius of curvature of the borehole segment shown in FIG. 5*b* is greater than the radius of curvature of the borehole segment shown in FIG. 5*a*. It can be seen that binding between the BHA 10 and the wall 50 of the borehole 30 increases as the radius of curvature increases. This is illustrated conceptually by binding shown at 76, 78 and 80.

Figure 6:
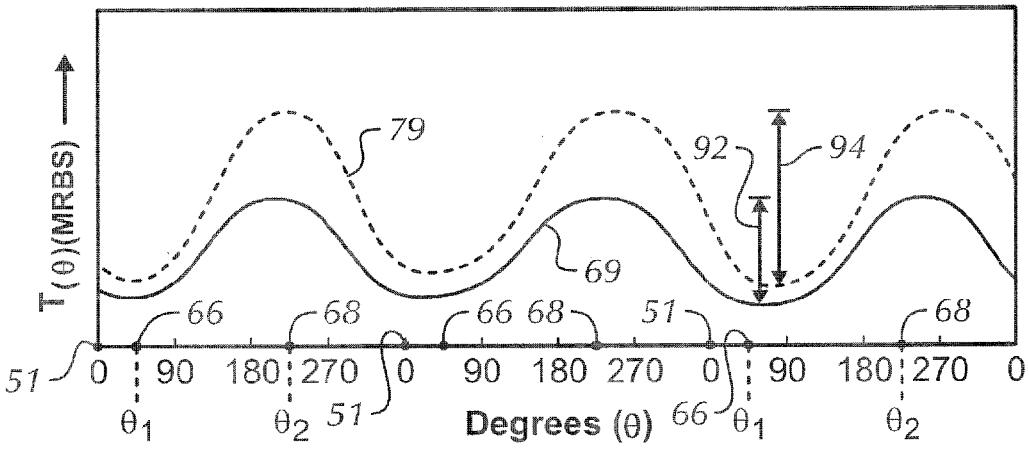
FIG. 6 illustrates the corresponding values of azimuthal torque $T(\theta)$ in the boreholes with the first and second radius of curvatures.

FIG. 6 illustrates the corresponding values of azimuthal torque T(θ) (solid curve 69) computed using equation (2) for the borehole shown in FIG. 5*a*. FIG. 6 also illustrates the corresponding values of azimuthal torque T(θ) (broken curve 79) computed using equation (2) for the borehole shown in FIG. 5*b*. Periodic components are shown in both curves. Plots of $R_{D,BHA}$, from which curves of T(θ) were computed and which also undergo periodic variations, are not shown for brevity. As in previous illustrations, minimum and maximum values of T(θ) occur at 66 (angle $\theta_1$) and 68 (angle $\theta_2$), respectively. At any given angle θ, the value of T(θ) is, however, greater in curve 79 due to increased binding between the BHA and the wall of the borehole. A relative measure of borehole curvature can be obtained from the magnitude of the periodic variations in azimuthal torque T(θ). This periodic variation can be quantified using number of methods, as will be apparent to those of ordinary skill in the art. The preferred method for quantifying the variation is to compute the magnitude of torque variation, ΔT(θ), between maxima and minimum values. Stated mathematically, $$\Delta T(\theta)=T(\theta_2)-T(\theta_1) \tag{3}$$

where $T(\theta_2)$ and $T(\theta_1)$ are the maximum and minimum torque values obtained during a complete rotation cycle. Values for ΔT(θ) are shown at 94 and 92 in FIG. 6 for corresponding BHA orientations shown In FIGS. 5*b* and 5*a*, respectively. The value ΔT(θ) is, therefore a quantitative indicator of the relative radius of curvature of a segment of borehole in which the BHA is disposed. This relative radius of curvature is useful in numerous borehole steering operations. Alternately, the absolute radius of curvature can be obtained from the relative radius of relative curvature by operating the system in segments of borehole of known radius. A generalized mathematical relationship for determining absolute radius of curvature is $$\mathrm{CUR}=K_c T(\theta) \tag{4}$$

where $K_c$ is a calibration constant obtained in known borehole conditions.

CONCLUSION

This invention comprises apparatus and methods determining borehole parameters of interest comprising the direction of borehole azimuthal offset and the borehole radius of curvature. The invention also indicates that the borehole is non-deviated or straight. Azimuthal offset and radius of curvature are determined from the effects of azimuthal torque T(θ) imparted to the borehole assembly (BHA) that terminates the lower end of the drill string. The preferred method for determining azimuthal torque T(θ) at the BHA is by first measuring the rotation rate $R_{D,BHA}$ of the borehole assembly over predetermined arcs θ of a rotation cycle. Measures of $R_{D,BHA}$ are determined with respect to a reference or "zero" angle with an independent orientation measurement from one or more sensors in an auxiliary sensor segment of the BHA. Azimuthal torque T(θ) imparted to the BHA is then computed from measures of $R_{D,BHA}$, and expressed as a relative offset or as an absolute offset direction using the reference angle. Radius of curvature is determined from variations ΔT(θ) in magnitude of azimuthal torque T(θ) and is expressed as a relative value or alternately as an absolute value by calibrating the system in boreholes with known radius of curvatures. A measure of relatively constant azimuthal torque T(θ) (i.e. ΔT(θ)=0) over a complete BHA rotation cycle indicates that the borehole segment in which the BHA is disposed is straight. The direction of azimuthal offset and radius of curvature can be telemetered to the surface to generate a "log" of the borehole path. Alternately, these borehole parameters of interest can be input into the downhole processor of the BHA and used to supply directional information to the pulsed modulated steering system of alternately to any borehole steering system.

The above disclosure is to be regarded as illustrative and not restrictive, and the invention is limited only by the claims that follow.

What is claimed is:

1. A method for obtaining a parameter of interest of a borehole segment in which a borehole assembly (BHA) is disposed, the method comprising:

determining azimuthal torque imparted to said BHA; and determining said parameter of interest from a periodic variation of said azimuthal torque over a rotation cycle of said BHA; wherein said azimuthal torque is computed within said BHA using a response of a rotation rate sensor disposed within said BHA;

said parameter of interest is relative direction of azimuthal offset of said BHA; and said relative direction of azimuthal offset is determined from maxima and minima in said periodic variations of said azimuthal torque over said rotation cycle of said BHA.

2. The method of claim 1 wherein:

said parameter of interest is relative radius of curvature of said borehole segment; and said relative radius of curvature is computed from a magnitude of variation of said azimuthal torque computed for one said rotation cycle of said BHA.

3. The method of claim 1 wherein an absolute direction of azimuthal offset is obtained by combining said relative direction of azimuthal offset with an absolute reference angle measured independently by said BHA.

4. The method of claim 2 wherein said relative radius of curvature of said borehole is combined with a calibration constant to obtain an absolute radius of curvature.

5. A method for obtaining azimuthal offset and radius of curvature of a borehole segment in which a borehole assembly (BHA) is disposed, the method comprising:

determining, over at least one rotation cycle and in a plurality of predetermined arcs, rotation rates of said BHA using a sensor disposed within said BHA;

from said rotation rates, determining in said plurality of predetermined arcs azimuthal torques acting upon said BHA;

determining a difference of a maximum and a minimum of said torques over said at least one rotation cycle;

from angular positions of said maximum and minimum with respect to a reference angle, determining said azimuthal offset; and from a magnitude of said difference of said maximum and minimum, determining said radius of curvature.

6. The method of claim 5 wherein said predetermined arc is about 2 degrees.

7. The method of claim 5 further comprising:

with a sensor disposed within said BHA, determining an absolute direction for said reference angle; and from said absolute direction of said reference angle, determining an absolute direction for said azimuthal offset.

8. The method of claim 5 further comprising:

measuring said radius of curvature in a borehole segment of known radius;

combining said radius of curvature with said known radius to obtain a calibration constant; and multiplying subsequent measures of said radius of curvature and said calibration constant to obtain an absolute radius of curvature.

9. The method of claim 5 further comprising measuring said azimuthal offset and said radius of curvature while drilling said borehole segment.

10. The method of claim 5 further comprising telemetering said azimuthal offset and said radius of curvature to the surface of the earth as a function of depth of said borehole segment.

11. A borehole assembly (BHA) comprising:

a sensor for measuring rotation rates of said BHA in a plurality of predetermined arcs in a segment of borehole in which said BHA is disposed; and a processor disposed within said BHA cooperating with said sensor and programmed to compute torques acting upon said BHA from said rotation rates in said plurality of predetermined arcs;

compute a difference of a maximum and a minimum of said torques over at least one rotation cycle;

compute azimuthal offset from angular positions of said maximum and minimum with respect to a reference angle; and compute radius of curvature from a magnitude of said difference of said maximum and minimum.

12. The BHA of claim 11 further comprising a directional drilling system that receives said azimuthal offset and said radius of curvature to direct the drilling path of said borehole.

13. The BHA of claim 11 further comprising a telemetry system with which said azimuthal offset and said radius of curvature are telemetered to the surface of the earth as a function of depth within said borehole at which they are measured.

* * * * *